United States Patent [19]

Berges et al.

[11] Patent Number: 4,525,129

[45] Date of Patent: Jun. 25, 1985

[54] OIL-SEALED VACUUM PUMP

[75] Inventors: Hanns-Peter Berges; Peter Frieden, both of Cologne; Wolfgang Leier, Bergisch Gladbach, all of Fed. Rep. of Germany

[73] Assignee: Leybold-Heraeus GmbH, Cologne, Fed. Rep. of Germany

[21] Appl. No.: 450,424

[22] Filed: Dec. 16, 1982

[30] Foreign Application Priority Data

Dec. 17, 1981 [DE] Fed. Rep. of Germany ..... 3150000

[51] Int. Cl.[3] ..... F01C 21/04; F04C 27/02; F04C 25/02

[52] U.S. Cl. ..... 418/84; 418/87; 418/88; 418/97; 417/281; 417/295; 417/298; 417/299

[58] Field of Search ..... 418/DIG. 1, 84, 87, 418/88, 89, 97, 99, 98; 417/279, 281, 295, 298, 299, 307; 184/15.1

[56] References Cited

U.S. PATENT DOCUMENTS

| | | | |
|---|---|---|---|
| 3,406,897 | 10/1968 | Diels | 230/138 |
| 3,463,387 | 8/1969 | Pfaff et al. | 230/207 |
| 3,707,339 | 12/1972 | Budgen | 418/13 |
| 3,811,468 | 5/1974 | Bellmer | 137/512.15 |
| 3,838,950 | 10/1974 | Andriulis | 418/76 |
| 4,120,621 | 10/1978 | Pikul | 418/99 |
| 4,132,289 | 1/1979 | Mäkela | 184/15.1 |
| 4,342,547 | 8/1982 | Yamada et al. | 418/84 |
| 4,366,834 | 1/1983 | Hanson et al. | 137/489.3 |
| 4,394,113 | 7/1983 | Bammert | 418/98 |

FOREIGN PATENT DOCUMENTS

| | | |
|---|---|---|
| 1011115 | 12/1957 | Fed. Rep. of Germany . |
| 1190134 | 4/1965 | Fed. Rep. of Germany . |
| 1994565 | 9/1968 | Fed. Rep. of Germany . |
| 1628285 | 3/1970 | Fed. Rep. of Germany . |
| 2028603 | 12/1970 | Fed. Rep. of Germany . |
| 2035938 | 2/1975 | Fed. Rep. of Germany . |
| 783770 | 9/1957 | United Kingdom . |
| 875444 | 8/1961 | United Kingdom . |
| 899202 | 6/1962 | United Kingdom . |
| 1126886 | 9/1968 | United Kingdom . |
| 1334225 | 10/1973 | United Kingdom . |

OTHER PUBLICATIONS

H. Wycliffe and B. D. Power, Pumped Oil Feed Systems for Rotary Vacuum Pumps, Apr. 1981, pp. 1160–1162.

*Primary Examiner*—Michael Koczo
*Assistant Examiner*—John J. McGlew, Jr.
*Attorney, Agent, or Firm*—Spencer & Frank

[57] ABSTRACT

An oil-sealed vacuum pump comprises an oil circuit for supplying a pump chamber and bearings of the vacuum pump with oil. The oil circuit includes first and second branch conduits leading to the bearings and the pump chamber, respectively. The vacuum pump further has an oil pump coupled to the oil circuit for driving oil therethrough, a valve assembly coupled to the oil circuit for shutting off oil supply to the pump chamber during standstill of the vacuum pump, and a pressure reducer coupled to the oil circuit for reducing the oil pressure to environmental pressure. The first branch conduit leading to the bearings is situated upstream of, and the second branch conduit leading to the pump chamber and the valve assembly are situated downstream of the pressure reducer as viewed in the direction of oil flow in the oil circuit.

10 Claims, 4 Drawing Figures

FIG. 2
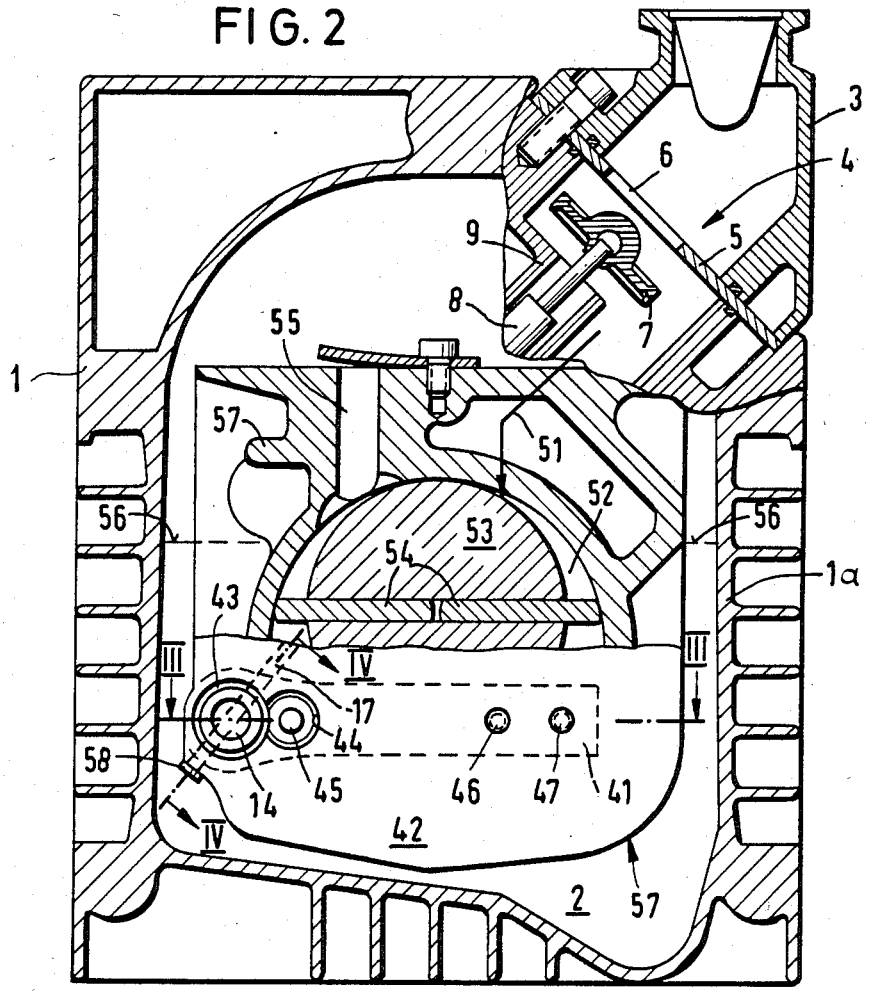
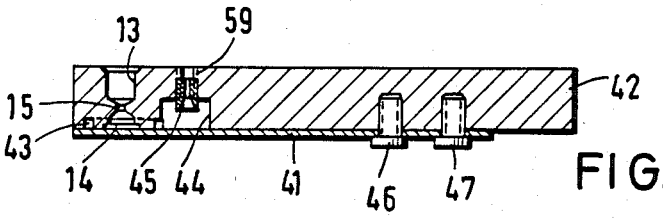
FIG. 3
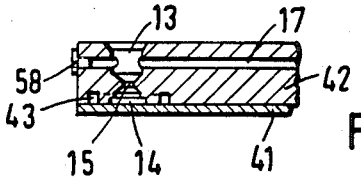
FIG. 4

OIL-SEALED VACUUM PUMP

BACKGROUND OF THE INVENTION

This invention relates to an oil-sealed vacuum pump which includes an oil circuit for supplying bearings and the pump chamber with oil as well as a valve arranged in the oil circuit for shutting off the oil supply to the pump chamber when the pump is at a standstill.

A vacuum pump of the above-outlined type is disclosed in British Pat. No. 875,444. The oil pump of the oil circuit of the vacuum pump disclosed in the British patent draws oil from a sump situated in the pump housing and drives the oil to a check valve-type arrangement whose closure member is biased by a very weak spring so that the oil pressure in the oil circuit is only slightly above atmospheric pressure. From the valve which opens when the pressure of the closing spring is overcome, the oil delivered in excess by the oil pump passes through the bearings of the pump shaft into the pump chamber and therefrom is reintroduced into the sump by a discharge valve.

It is a disadvantage of the above-outlined vacuum pump structure that the oil cannot be admitted to the bearings with a pressure which is significantly above the atmospheric pressure although such a higher oil pressure would be desirable for a reliable and continuous lubrication of the bearings. It would be thinkable to select a stronger spring for the check valve to cause an increase of the oil pressure in the oil circuit. This, however, would mean that the oil serving as a seal for the rotary piston is injected into the pump chamber with a continuous high pressure. The disadvantage of such an arrangement resides in the fact that at high suction pressures unnecessarily large oil quantities would be injected into the gases delivered in large quantities. This not only unnecessarily increases the oil consumption during the operation of a pump working at high suction pressures but also would mean an increased environmental pollution because of the high oil content in the gases expelled by the pump.

SUMMARY OF THE INVENTION

It is an object of the invention to provide an improved oil-sealed vacuum pump of the above-outlined type in which a reliable bearing lubrication with pressurized oil is achieved and yet, a pump operation up to 1000 millibar suction pressure is ensured without unnecessarily charging the delivered gases with oil vapors.

This object and others to become apparent as the specification progresses, are accomplished by the invention, according to which, briefly stated, the oil circuit which supplies the bearings of the pump chamber with oil has a pressure reducer for decreasing the overpressure, generated by the oil pump, to the atmospheric pressure and further, the conduit branches leading to the bearings are situated upstream of the pressure reducer, whereas the conduit branch leading to the pump chamber and to the shutoff valve are situated downstream of the pressure reducer as viewed in the direction of the oil flow.

In a vacuum pump structured as outlined above, with the aid of the oil pump and the pressure reducer a relatively high pressure may be maintained in that part of the oil circuit which supplies the bearings with lubricating oil. The pump chamber is supplied with depressurized oil so that the pump operates as a self-drawing pump. Such a pump draws little oil at high suction pressures while during operation at final pressures it draws a large quantity of oil. The increased oil consumption and the pollution of the environment at high suction pressures are thus significantly reduced with a pump structured according to the invention.

Further, an oil supply of the bearings by an oil circuit of relatively high pressure makes possible the use of an oil filter in this part of the oil line. Due to a relatively high pressure difference across the oil filter, only purified oil will be admitted to the bearings. It is further feasible to monitor the pump by means of the oil pressure which is an unequivocal indicator of the operational condition of the pump.

Further, supplying the pump chamber with oil by the subsequent, depressurized part of the oil circuit has the advantage that the pump chamber too, receives solely purified oil.

The shutoff valve ensures that when the pump is stopped, the oil quantities which are inside the pump chamber are reliably limited. This is of decisive advantage in the cold start of the pump and thus has a direct effect on the dimensioning of the pump motor. An undesirable oil increase in the pump and in the suction nipple during an accidental reverse run of the pump is also reliably prevented.

BRIEF DESCRIPTION OF THE DRAWING

FIG. 2 shows a preferred embodiment of a vacuum pump according to the invention, illustrated partially in section and partially as viewed in the direction of the front side of the pump body.

FIG. 3 is a sectional view taken along line III—III of FIG. 2.

FIG. 4 is a sectional view taken along line IV—IV of FIG. 2.

DESCRIPTION OF THE PREFERRED EMBODIMENT

Figure 1:
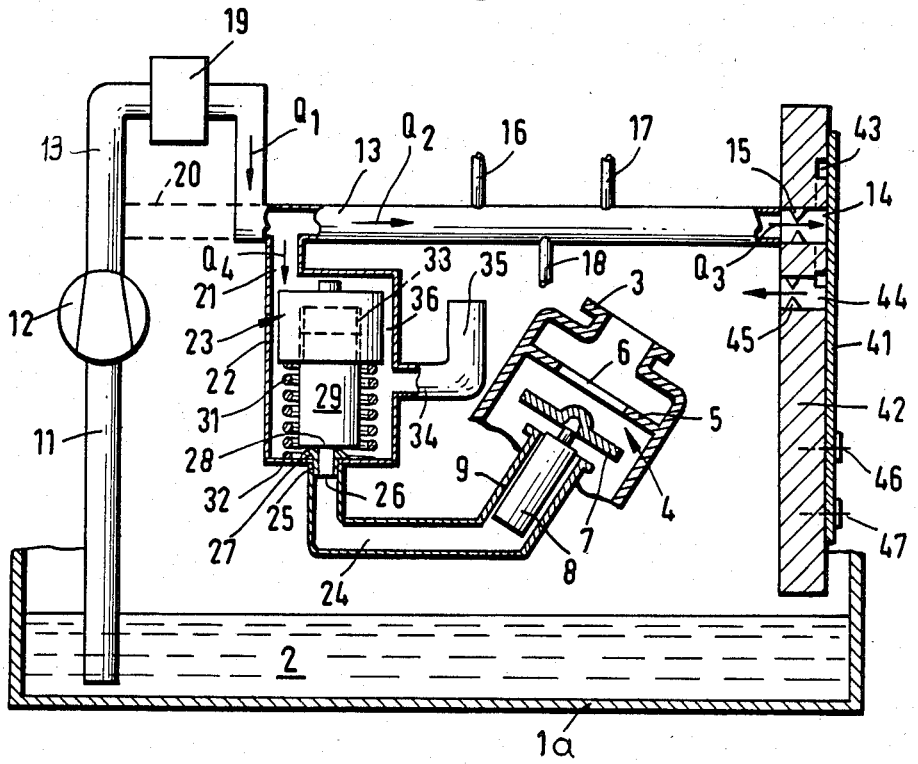
FIG. 1 is a schematic elevational view of an oil circuit associated with a vacuum pump, according to a preferred embodiment of the invention.

Turning now to FIG. 1, there are shown, in essence, those components of a vacuum pump which are deemed to aid in understanding the invention. Thus, the pump comprises an outer housing 1 including an oil sump 1*a* which is partially filled with oil 2. There is further shown a suction nipple 3 and a suction nipple valve 4, the latter being formed by a plate-like valve seat 5 provided with an opening 6 and a movable valve disc 7. The valve disc 7 is connected with a piston 8 which is displaceable in a cylinder 9.

The oil circuit of the vacuum pump comprises a suction conduit 11 through which, by means of an oil pump 12, oil is drawn from the sump 1*a* and driven into a pressure conduit 13. In the zone of the outlet opening 14 of the pressure conduit 13 there is arranged a throttle (pressure reducer) 15 which maintains the desired oil pressure (between 1.5 and 2 bar, preferably 1.7 bar) and by means of which the pressure of the oil is reduced to the pressure prevailing in the oil sump 1*a*. The bearings of the vacuum pump are supplied with pressurized oil by means of branch conduits 16, 17 and 18 of the oil circuit. Three oil supply conduits (16, 17 and 18) are required in case of a two-stage pump in which two end bearings and one intermediate bearing of the two rotors have to be supplied with oil. In case of a one-stage pump, two branch conduits are sufficient. After the pressurized oil supplied by the branch conduits 16, 17 and 18 has passed through the bearings, it returns to the oil sump 1*a*.

In the pressure conduit 13, immediately downstream of the oil pump 12, there is arranged an oil filter 19 to ensure that exclusively purified oil flows in the pressure conduit 13 and the branch conduits downstream of the oil filter 19.

A further branch conduit 21 extends from the pressure conduit 13 and opens into a control cylinder 22 which accommodates a control piston 23. An oil conduit 24 opens, at 25, into the control cylinder 22 at that side of the control piston 23 which is oriented away from the inlet of the conduit 21. The other end of the conduit 24 opens into the cylinder 9 adjacent that face of the piston 8 which is oriented away from the valve disc 7. The inlet opening 25 of the conduit 24 receives a plug 26 surrounded by a sealing grommet 27 to form a valve seat. The closing member of this valve is an end face 28 of a cylindrical extension 29 of the control piston 23. The extension 29 has a smaller diameter than that of the control piston 23. The control piston 23 is biased open by a spring 31 which is arranged between a shoulder of the control piston 23 and a cylinder end wall 32 which contains the inlet opening 25 of the conduit 24. The cylindrical extension 29 is threadedly engaged in the control piston 23 by means of a thread 33 so that the force of the spring 31 which acts when the control valve 27, 28 is in a closed position, may be varied.

A small-volume, open-top oil storage vessel 35 communicates with the control cylinder 22 by means of a conduit 34. The inlet opening of the conduit 34 in the cylinder 22 is adjacent that end face of the control piston 23 which is oriented away from the inlet of the conduit 21.

During operation of a vacuum pump constructed as described above, the oil pump 12 delivers oil from the oil sump 1*a* into the pressure conduit 13. The oil pump 12 may be a rotary vane pump or a gear pump and may be coupled to the vacuum pump shaft for being driven thereby, as described, for example, in British Pat. No. 875,444. The delivery characteristics of the oil pump 12 and the size of the throttle 15 are so designed that after the start of the vacuum pump the desired oil pressure is built up and maintained in the pressure conduit 13. The pressure in the conduit 13 exerts a force on the piston 23 and overcomes the force of the spring 31, so that the inlet opening 25 of the oil conduit 24 is closed. The suction nipple valve 4 is, under these conditions, in its open position so that the vessel coupled to the nipple 3 is evacuated.

During the above-outlined operational conditions predetermined oil quantities, designated at $Q_1$, $Q_2$ and $Q_3$ flow through the pressure conduit 13. The piston 23 defines, with the wall of the cylinder 22, a relatively wide clearance 36 so that the chamber of the cylinder 22 underneath the piston 23 and the oil storage vessel 35 are filled with oil. By virtue of the clearance 36 a steady oil flow of a quantity $Q_4$ is maintained through the conduit 21. Excess oil is returned by overflow from the oil storage vessel 35 to the sump 1*a*. The oil pump 12 is so dimensioned that the entire oil circuit is operated with excess oil, that is, at all times more oil flows in the circuit than required by the vacuum pump.

When the vacuum pump is shut off, the oil quantities delivered by the oil pump simultaneously decrease so that the oil pressure in the pressure conduit 13 is reduced. When the pressure in the conduit 13 falls below a predetermined value, the force of the spring 31 lifts the piston 23 off the opening 25, so that by virtue of the atmospheric pressure prevailing at the upper surface of the oil in the oil reservoir 35, oil is forced into the conduit 24 and is introduced underneath the piston 8 into the cylinder 9. The oil quantity underneath the piston 23 and in the oil reservoir 35 is so small that the oil introduced into the cylinder 9 serves essentially only for sealing the piston 8 against the cylinder wall in which it slides. The pressure medium proper for actuating the piston 8 is air which is introduced into the conduit 24 behind the oil through the oil reservoir 35. The entire oil quantity in the cylinder 22 and in the oil storage vessel 35 amounts to a few $cm^3$. This oil quantity should be so small that it serves essentially only as a seal for the clearance situated between the piston 8 and the cylinder 9. These occurrences ensure a closing of the suction nipple valve 4 without an undesirable intake of air. After the suction nipple valve 4 is closed and the air entering behind the oil has displaced the oil situated between the piston 8 and the cylinder wall 9, an airing of the pump chamber occurs. The operation of the suction nipple valve control is independent from the presence of the oil filter 19, that is, even in an oil circuit without an oil filter (as symbolized by the broken-line bypass 20), the suction nipple valve 4 and its control operate in a satisfactory manner.

A particular advantage of the construction of the suction nipple valve 4 and its control operating as a function of the oil pressure resides in that both cylinder and piston arrangements 8, 9 and 22, 23 are, because of the desired clearance between respective piston and cylinder not subject to strict manufacturing tolerances and therefore are inexpensive to make. By appropriate choice of the oil quantities $Q_1$ and $Q_4$ and by a corresponding adaptation of the force of the spring 31, the control arrangement may be adjusted such that even at relatively small pressure drops in the oil circuit (for example, a decrease of the desired pressure from approximately 1.7 bar to 1.5 bar) the inlet opening 25 of the conduit 24 is opened. The delay of response of the suction nipple valve 4 is, due to the hydro-pneumatic actuation, so short that it is ensured that even before standstill (that is, during inertia runout) of the vacuum pump the suction nipple valve 4 is closed. In general, the actuation of the suction nipple valve by means of the oil pressure in an oil circuit which is supplied by a vacuum pump shaft-driven oil pump has the advantage of a rapid and reliable operation, since the operational condition of the vacuum pump is unequivocally indicated by the oil pressure in the oil circuit.

With the outlet opening 14 of the pressure conduit 13 there is associated a spring biased closure 41 which, together with a particularly structured wall 42 in the zone of the outlet opening 14 performs several functions. The outlet opening 14 is surrounded by a groove 43 which is provided in the wall 42 and which is concentric with the outlet opening 14. The groove 43 extends to a bore 44 through which oil passes for supplying the pump chamber. The bore 44 is provided with a throttle 45 whose size is adapted to the suction power of the vacuum pump. The resilient closure 41 which is preferably an elastic steel strip, covers both the outlet opening 14 of the oil pressure conduit 13 and the bore 44. The spring force of the resilient closure 41 and the distance of its mounting points 46, 47 on the wall 42 from the oil ports 14 and 44 are so selected that they effect only a negligible pressure drop for the oil exiting the outlet opening 14. Thus, for all practical purposes, the oil is discharged through the outlet opening 14 with the pressure prevailing in the sump 1*a*. Further, at this location of the oil circuit too, the circulation is effected by means of excess oil, that is, even at the final pressure run of the vacuum pump, more oil is discharged through the outlet opening 14 than drawn by the pump through the throttle 45 arranged in the bore 44.

During operation of the vacuum pump, oil under pressure is, by virtue of the throttle 15, depressurized to the pressure prevailing in the oil sump 1*a*. The depressurized oil first flows into the groove 43 surrounding the outlet opening 14. From the groove 43 which communicates with the bore 44, one part of the oil flows, by virtue of the suction effect of the pump chamber, through the throttle 45 of the bore 44. Excess oil is reintroduced into the oil sump 1*a*. The resilient closure 41 ensures that only oil which has left the outlet opening 14 flows through the bore 44 and the throttle 45. Therefore, exclusively oil which has flown through the oil filter 19 is introduced into the vacuum pump chamber and consequently, the pump chamber cannot be endangered by soiled oil. Nevertheless, the vacuum pump operates as a self-drawing pump, that is, it determines itself the oil quantities it requires. In high pressure ranges, for example, small oil quantities flow through the throttle 45, so that undesirably high oil vapor components are no longer present in the gas removed by the vacuum pump. It is independently ensured that the vacuum pump bearings are supplied with pressurized lubricating oil.

Further, the resilient closure 41 and the groove 43 effect an oil shutoff during standstill of the vacuum pump. In such an operational condition the vacuum prevailing in the pump chamber causes, through the bore 44, the resilient closure 41 to be tightly pressed against the wall 42. In this manner, the closure 41 completely seals the bore 44 so that no oil supply to the vacuum pump can take place. This solution yields a further advantage: in general, it has been a problem that during an accidental reverse run of the pump (because of an erroneous switching) an undesired oil increase in the suction nipple 3 could occur. With the above-described arrangement, however, such oil increase is reliably prevented.

Turning now to FIG. 2, there is illustrated in section a rotary vane-type vacuum pump. During the operation of the pump the delivered gases, after they flow through the suction nipple 3, the open suction nipple valve 4 and a suction channel (designated by an arrow 51) are admitted into the pump chamber 52 which accommodates a rotor 53 with the vanes 54. The compressed gases are introduced through the outlet channel 55 into the oil sump 1*a* which is filled with oil up to the line 56 so that the resilient closure 41 is situated underneath the oil surface. The exhaust nipple proper is not shown.

The end wall 42 of the pump block 57 arranged in the oil sump 1*a* of the pump housing 1 is shown in elevation at its lower portion. Sections III—III and IV—IV taken through the frontal wall are illustrated in FIGS. 3 and 4. The pressure conduit 13 with the throttle 15 terminates in the front wall 42. Prior to the depressurization of the oil to the pressure prevailing in the oil sump 1*a* by virtue of the throttle 15, there is effected a lubrication of the bearing of the vacuum pump shaft (not shown) supported in the front wall 42. For this purpose oil is supplied in a branch conduit (port) 17. The port 17 is blocked outwardly by a plug 58.

The resilient closure 41 (shown in broken lines in FIG. 2) is secured to the front wall 42 by means of screws 46 and 47. The closure 41 covers the two openings 14 and 44 as well as the groove 43 surrounding the opening 14. The throttle 15 is formed by a bilateral piercing of the front wall 42. The throttle 45 is threadedly engaged in the front wall 42 by means of a thread 59 so that, dependent upon the suction power of the vacuum pump, different throttles 45 may be used.

It will be understood that the above description of the present invention is susceptible to various modifications, changes and adaptations and the same are intended to be comprehended within the meaning and range of equivalents of the appended claims.

What is claimed is:

1. An oil circuit arrangement forming a combination with an oil-sealed vacuum pump having a pump chamber and bearings, said combination comprising:

(a) an oil circuit for supplying said pump chamber and bearings with oil, said oil circuit including first and second branch conduits leading to said bearings and said pump chamber, respectively;

(b) an oil pump coupled to said oil circuit for driving oil therethrough;

(c) valve means coupled to said oil circuit for shutting off oil supply to said pump chamber during standstill of said vacuum pump; and (d) pressure reducing means coupled to said oil circuit for reducing the oil pressure to atmospheric pressure; said first branch conduit leading to said bearings being situated upstream of, and said second branch conduit leading to said pump chamber and said valve means being situated downstream of said pressure reducing means as viewed in the direction of oil flow in said oil circuit for supplying said pump chamber with oil at atmospheric pressure and for supplying said bearings with oil at higher-than-atmospheric pressure.

2. The combination as defined in claim 1, wherein said pressure reducing means comprises a throttle.

3. The combination as defined in claim 1, further comprising (e) an outer pump housing;

(f) a pump block accommodated in said outer pump housing; and (g) an end wall forming a part of said pump block and containing said pressure reducing means.

4. The combination as defined in claim 3, further comprising (h) means defining an outlet opening in an outer face of said end wall downstream of said pressure reducing means in communication therewith;

(i) means defining an inlet opening in said outer face of said end wall adjacent said outlet opening, said inlet opening forming part of said second branch conduit leading to said pump chamber; and (j) control means mounted on said outer face of said end wall for receiving all the oil discharged through said outlet opening and for allowing solely excess oil to enter said inlet opening.

5. The combination as defined in claim 4, wherein said oil circuit comprises a pressure conduit containing said pressure reducing means and further wherein said first branch conduit comprises a port formed in said pump block and communicating with said pressure conduit upstream of said pressure reducing means; said port being closed towards the outside of said pump block.

6. The combination as defined in claim 4, wherein said control means comprises means defining an annular groove provided in said outer face of said end wall and surrounding said outlet opening; said annular groove commmunicating with said inlet opening; and a resilient closure mounted on said outer face of said end wall and covering said inlet opening, said outlet opening and said annular groove.

7. The combination as defined in claim 6, wherein said resilient closure is an elastic steel strip.

8. The combination as defined in claim 6, wherein said annular groove is concentric with said outlet opening.

9. The combination as defined in claim 4, wherein said second branch conduit includes a portion formed in said end wall; further comprising a throttle situated in said portion of said second branch conduit.

10. The combination as defined in claim 9, wherein said throttle is removably supported in said end wall by a threaded engagement.

* * * * *